US005299387A

United States Patent [19]

Miller et al.

[11] Patent Number: 5,299,387

[45] Date of Patent: Apr. 5, 1994

[54] SENSING EDGE FOR A GATE

[75] Inventors: Bearge D. Miller, Concordville; Anatoly Galperin, Philadelphia, both of Pa.

[73] Assignee: Miller Edge, Inc., Concordville, Pa.

[21] Appl. No.: 837,300

[22] Filed: Feb. 14, 1992

[51] Int. Cl.[5] ..... E05F 15/02

[52] U.S. Cl. ..... 49/28; 49/27; 49/493.1; 200/61.43

[58] Field of Search ..... 49/27, 26, 28, 488, 49/492, 493; 200/61.43

[56] References Cited

U.S. PATENT DOCUMENTS

| | | | |
|---|---|---|---|
| 2,135,131 | 11/1938 | Bassett | 49/27 X |
| 2,740,856 | 4/1956 | Doeg | 200/61.43 |
| 2,891,289 | 6/1959 | Guilbert | 49/488 |
| 3,133,167 | 5/1964 | Miller | 200/61.43 |
| 3,154,303 | 10/1964 | Cavallero et al. | 49/27 X |
| 3,243,540 | 3/1966 | Miller | 200/86 |
| 3,260,812 | 7/1966 | Miller | 200/61.43 |
| 3,315,050 | 4/1967 | Miller | 200/61.43 |
| 3,321,592 | 5/1967 | Miller | 200/61.43 |
| 3,462,885 | 8/1969 | Miller | 49/488 |
| 3,509,360 | 4/1970 | Miller | 307/119 |
| 3,654,407 | 4/1972 | Kepner et al. | 200/86 R |
| 3,693,026 | 9/1972 | Miller | 307/119 |
| 3,754,176 | 8/1973 | Miller | 318/266 |
| 3,855,733 | 12/1974 | Miller | 49/488 |
| 4,051,336 | 9/1977 | Miller | 49/27 X |
| 4,090,045 | 5/1978 | Marsh | 200/5 A |
| 4,137,116 | 1/1979 | Miller | 156/269 |
| 4,143,367 | 3/1979 | Schestag | 200/61.43 X |
| 4,273,974 | 6/1981 | Miller | 200/61.43 |
| 4,396,814 | 8/1983 | Miller | 200/61.43 |
| 4,401,896 | 8/1983 | Fowler et al. | 307/118 |
| 4,497,989 | 2/1985 | Miller | 200/86 R |
| 4,773,155 | 9/1988 | Buchien | 29/622 |
| 4,951,985 | 8/1990 | Pong et al. | 200/61.43 X |
| 4,954,673 | 9/1990 | Miller | 200/61.43 |
| 5,023,411 | 6/1991 | Miller et al. | 200/61.43 |
| 5,027,552 | 7/1991 | Miller et al. | 49/27 |
| 5,072,079 | 12/1991 | Miller | 200/61.43 |
| 5,079,417 | 1/1992 | Strand | 49/27 |

FOREIGN PATENT DOCUMENTS

| | | | |
|---|---|---|---|
| 2643505 | 9/1976 | Fed. Rep. of Germany | 200/61.43 |

*Primary Examiner*—Peter M. Cuomo
*Assistant Examiner*—Jerry Redman
*Attorney, Agent, or Firm*—Panitch Schwarze Jacobs & Nadel

[57] ABSTRACT

A sensing edge for a gate to protect persons, equipment and the gate from impact damage. The sensing edge includes a mounting member which is snap-fit to the leading member of the gate and extends around a portion of the external surface of the leading member of the gate. An elongate outer sheath surrounds the mounting member and a switch is positioned between the sheath and mounting member for actuation of the device upon application of pressure to the exterior surface of the sheath. The sensing edge extends sufficiently around the leading and side edges of the leading member to permit the device to be actuated in response to forces which approach the leading member at an angle.

12 Claims, 3 Drawing Sheets

SENSING EDGE FOR A GATE

FIELD OF THE INVENTION

The present invention relates to a sensing edge for a gate and, more particularly, to a sensing edge for causing a closing gate to open by actuation of a device upon force being applied to the sensing edge.

BACKGROUND OF THE INVENTION

The use of sensing edges on moving gates is generally known. Such sensing edges generally include a sheath having an area therein wherein at least a portion of a switch means is located. The sensing edge typically extends outwardly from the leading member of the gate in the direction of travel of the gate. Further, the sensing edge is typically attached to the leading member or pole of the gate by standard fastening methods, such as adhesive or screws. However, such sensing edges are problematic in that they do not extend sufficiently around the portion of the leading member which may engage an object in the path of the gate. That is, while the conventional sensing edges will sense objects directly in the linear path of the moving gate, such sensing edges are not capable of sensing objects which approach the gate at an angle or on the side of the leading member.

Moreover, conventional sensing edges are secured to the leading member of the gate by additional standard fastening elements, such as adhesives or standard hardware (i.e., screws). In the event of one or more of the fastening elements failing, the sensing edge may become partially detached from the leading member of the gate and thereby inhibit its operability. Hence, a need has arisen for a sensing edge which remains attached to the leading member of the gate in the event of a partial or total failure of the additional fastening elements.

The present invention is directed to a sensing edge for causing a closing gate to open by actuation of a device upon force being applied to the sensing edge. The sensing edge includes a mounting member which is shaped to snap fit around a portion of the external surface of the leading member of the gate. This permits the mounting member to remain secured to the leading member of the gate in the event of a partial or total failure of the additional fastening elements. The sensing edge extends sufficiently around the leading and side edges of the leading member to permit the device to be actuated in response to forces which approach the leading member at an angle or on the side thereof.

SUMMARY OF THE INVENTION

Briefly stated, the present invention comprises a sensing edge for a gate to protect persons, equipment and the gate from impact damage. The gate includes a leading member having an external surface. A mounting member secures the sensing edge to the leading member of the gate. The mounting member includes first and second lateral edges. The mounting member further includes an outer surface and an inner surface defining a first area for receiving in facing engagement a portion of the leading member. The inner surface being sized and shaped to extend around a portion of the external surface of the leading member. The sensing edge further includes an elongate outer sheath having a first lateral edge, a second lateral edge, an interior surface and an exterior surface. The first and second lateral edges of the sheath are spaced apart and secured proximate to the first and second lateral edges of the mounting member. The interior surface of the sheath is spaced from the outer surface of the mounting member to thereby define a second area for receiving a switch means. The switch means is positioned within the second area for actuation of the device upon application of pre to the exterior surface of the sheath.

BRIEF DESCRIPTION OF THE DRAWINGS

The foregoing summary, as well as the following detailed description of preferred embodiments, will be better understood when read in conjunction with the appended drawings. For the purpose of illustrating the invention, there is shown in the drawings embodiments which are presently preferred, it being understood, however, that the invention is not limited to the specific methods and instrumentalities shown. In the drawings.

DESCRIPTION OF PREFERRED EMBODIMENTS

Figure 1:
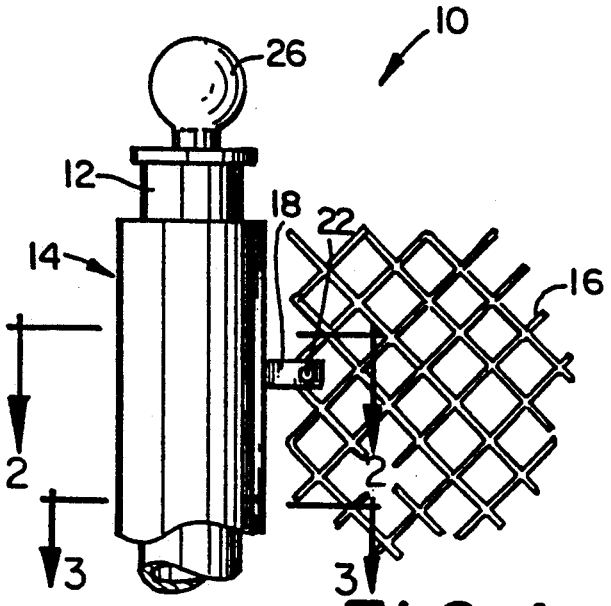
FIG. 1 is a front elevational view showing a portion of a gate construction including a sensing edge in accordance with the present invention.

Certain terminology is used in the following description for convenience only and is not limiting. The words "right," "left," "lower" and "upper" designate directions in the drawings to which reference is made. The words "inwardly" and "outwardly" refer to directions toward and away from, respectively, the geometric center of the sensing edge and designated parts thereof. The terminology includes the words above specifically mentioned, derivatives thereof and words of similar import.

Referring to the drawings in detail, wherein like numerals indicate like elements throughout, there is shown in FIG. 1 a gate, generally designated 10, having a leading member 12 for receiving a sensing edge 14. In the present embodiment, the gate 10 is automatically driven by a standard drive mechanism (not shown) and travels generally horizontally in a generally linear direction between an open position and a closed position. It is understood by those skilled in the art that the gate 10 may travel vertically or may be of the hinged, pivoting type without departing from the spirit and scope of the invention. Mechanisms (not shown) capable of actuating the gate 10 are well known to those skilled in the art and, therefore, further description thereof is omitted for purposes of convenience only and is not limiting.

Figure 2:
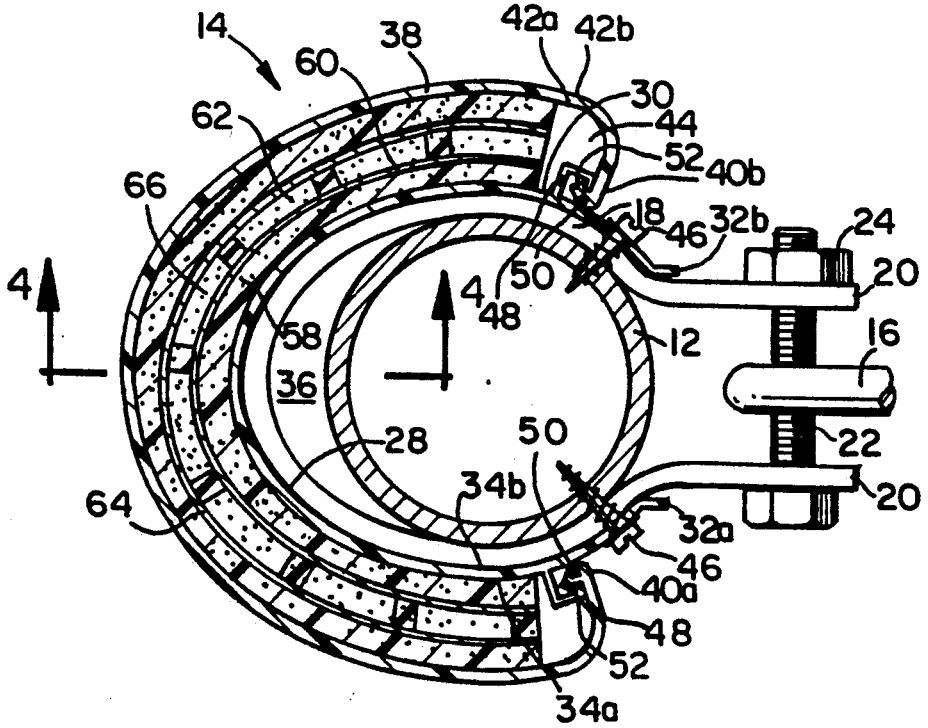
FIG. 2 is a greatly enlarged cross-sectional view of the sensing edge of FIG. 1 taken along line 2—2 of FIG. 1.

As shown in FIGS. 1 and 2, the leading member 12 is preferably generally cylindrically shaped and has a predetermined outer diameter. A decorative element 26 is secured to the upper end thereof to provide the gate 10 with an overall aesthetically pleasing appearance. It is understood by those skilled in the art that the leading member 12 could be configured in other geometrical shapes, such as square, rectangular or triangular in cross section without departing from the spirit and scope of the invention and as described in more detail hereinafter in connection with the first and second alternate embodiments of the invention.

In the present embodiment, it is preferred that the body portion of the gate 10 be formed of chain-link type fencing 16, as is well understood by those skilled in the art. While in the present embodiment, it is preferred that the gate 10 be formed of the chain link fencing 16, it is also understood by those skilled in the art that the present invention is not limited to mounting the sensing edge 14 to any particular type of gate so long as the gate includes a leading member. That is, the sensing edge 14 could be used in connection with a wooden stockade-type gate, picket fence-type gate, vertical sliding gate, horizontal sliding gate, swinging gate, bi-parting swinging gate, vertical pivot gate, cantilever gate, or a pocket gate without departing from the spirit and scope of the invention.

The chain link fencing 16 is preferably secured to the leading member 12 by a series of brackets 18 (only one is shown) extending along the length of the leading member 12. In the present embodiment, it is preferred that the brackets 18 be elliptically shaped for receiving the generally cylindrical member 12 therethrough. The brackets 18 preferably include a pair of parallel legs 20 extending outwardly from the leading member 12. The distal end of each leg 20 includes an aperture for receiving a bolt 22. The bolt 22 preferably extends through the apertures of the legs 20 and through on of the links of the chain link fencing 16 to thereby secure the chain link fencing 16 to the leading member 12. The bolt 22 preferably includes a nut 24 to firmly secure the bolt 22 to the bracket 18.

Figure 4:
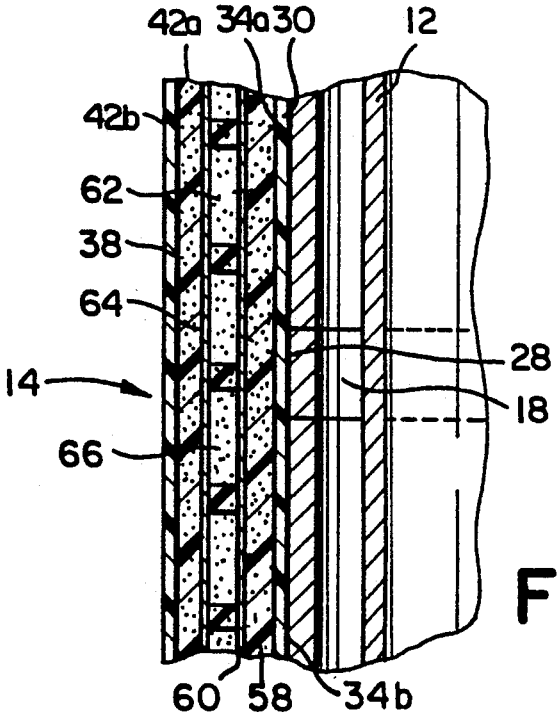
FIG. 4 is a cross-sectional view of the sensing edge in FIG. 2 taken along line 4—4 of FIG. 2.
Figure 5:
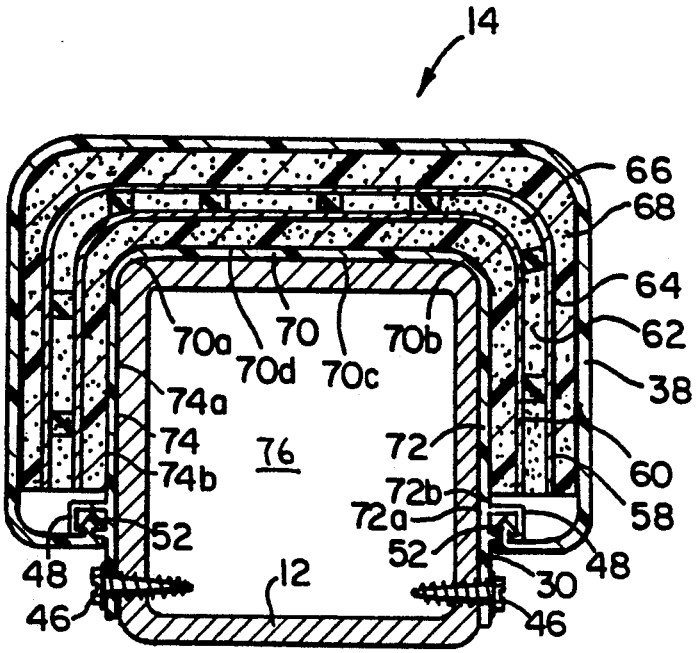
FIG. 5 is a greatly enlarged cross-sectional view a sensing edge in accordance with a first alternate e of the present invention.
Figure 6:
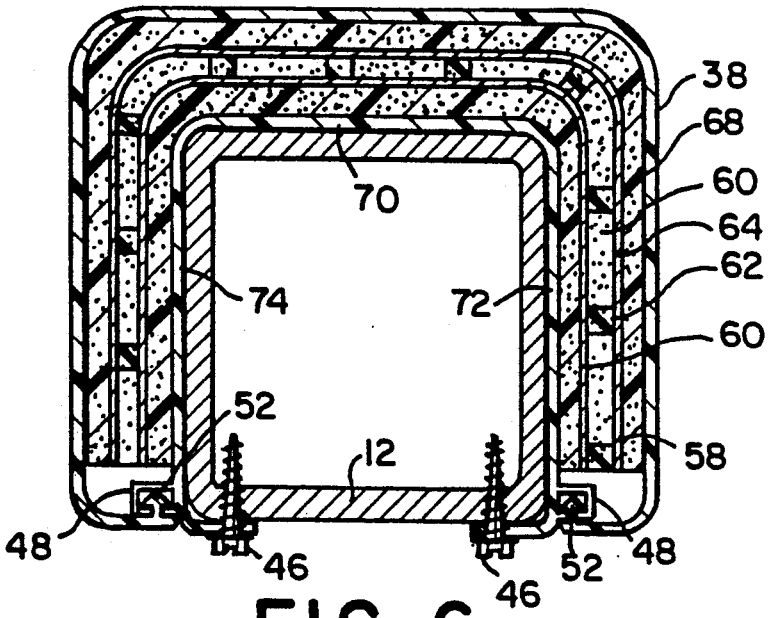
FIG. 6 is a greatly enlarged cross-sectional view in accordance with a second alternate embodiment of the present invention.

In the present embodiment, it is preferred that the leading member 12 include an external surface 28 for receiving the sensing edge 14. As shown in FIGS. 2 and 4, the external surface 28 is formed by the outer surface of the bracket 18. However, it is understood by those skilled in the art that where the fence is of the type that the bracket 18 is omitted the external surface 28 for receiving the sensing edge 14 is the external surface of the leading member 12, as shown in FIGS. 5 and 6.

While in the present embodiment, it is preferred that the sensing edge 14 be secured to the leading member 12 of the gate 10, it is understood by those skilled in the art that the gate 10 can include more than one sensing edge thereon. For instance, the sensing edge could be incorporated along the bottom edge of the gate 10, trailing edge of the gate 10, the crank arm of a moving gate or on the stationery portion of the fence proximate to the moving gate (all of which are not shown). By incorporating the sensing edge on different portions of the moving gate, the overall safety of the moving gate is improved.

Figure 3:
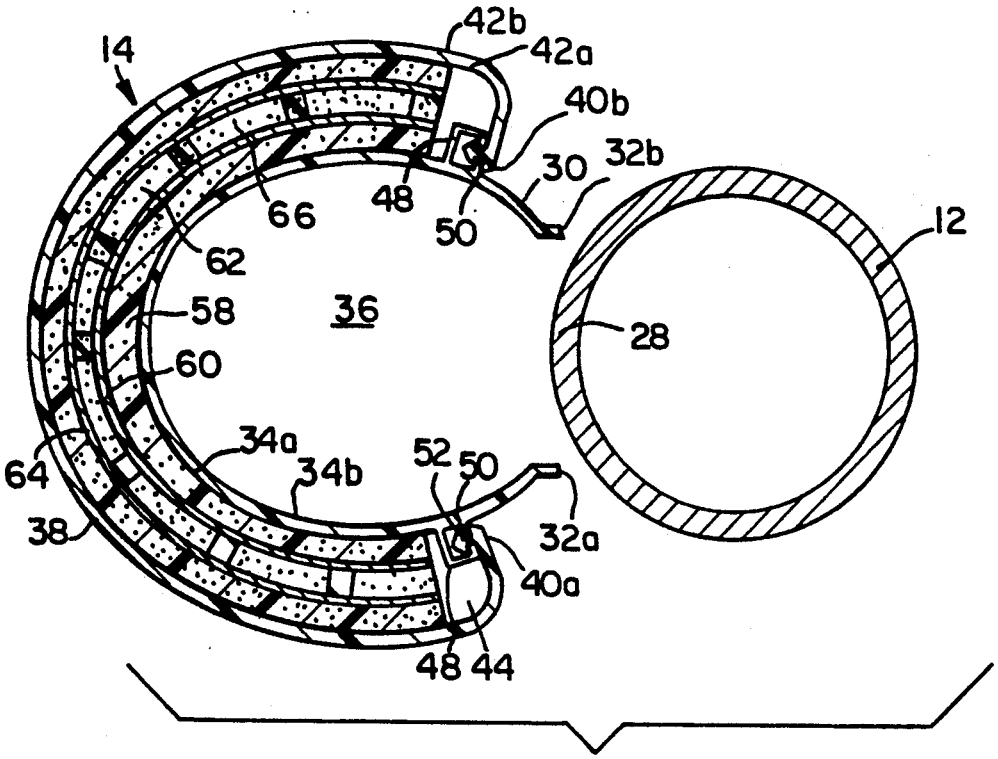
FIG. 3 is a greatly enlarged cross-sectional view showing of sensing edge separated from the gate of FIG. 1 taken along line 3—3 of FIG. 1.

Referring now to FIGS. 2 through 4, the sensing edge 16 includes a mounting member 30 for securing the sensing edge 14 to the leading member 12 of the gate 10. The mounting member 30 includes first and second lateral edges 32a, 32b. The first and second lateral edges 32a, 32b extend the entire length of the sensing edge 14 which extends substantially the entire length of the leading member 12. The mounting member 30 further includes an outer surface 34a and an inner surface 34b defining a first area 36 for receiving in facing engagement a portion of the leading member 12. As used herein, the term leading member 12 includes either the leading member 12 per se or the brackets 18 in combination with the leading member 12. The inner surface 34b is preferably sized and shaped to extend around a sufficient portion of the external surface 28 of the leading member 12 such that the sensing edge 14 is sensitive to forces or objects in the direct path of the leading member 12 and at an angle thereto.

In the present embodiment, it is preferred that the mounting member 30 be constructed of a material having a sufficient degree of flexibility to allow the lateral edges 32a, 32b of the mounting member 30 to move toward and away from each other such that the leading member 12 and brackets 18 can be snap-fit within the first area 36 to thereby frictionally secure the sensing edge 14 to the leading member 12. In the present embodiment, it is preferred that the mounting member 30 be constructed of a polymeric material, such as polyvinyl chloride, which can be formed by an extrusion process. However, it is understood by those skilled in the art that the mounting member 30 could be constructed of other polymeric materials or metallic materials as long as the requisite degree of flexibility is provided to obtain the snap-fit. Similarly, the mounting member 30 can be formed by other processes, such as die cast molding or compression molding.

Referring now to FIG. 2, the sensing edge 14 preferably includes an elongate outer sheath 38 having a first lateral edge 40a, a second lateral edge 40b, an interior surface 42a and an exterior surface 42b. The first and second lateral edges 40a, 40b of the sheath 38 are spaced apart from each other and secured to the mounting member 30 proximate the first and second lateral edges 32a, 32b thereof. Further, the interior surface 42a of the sheath 38 is spaced from the outer surface 34a of the mounting member 30 to thereby define a second area 44 for complementarily receiving a switch means, described hereinafter.

In the present embodiment, it is preferred that the sheath 38 be constructed of a flexible material such that the sheath 38 is compressible into the second area 44 upon application of external pressure thereto. It is preferred that the flexible material be a polymeric material, such as polyvinyl chloride, which can be formed by an extrusion process. However, it is understood by those skilled in the art that the sheath 38 could be constructed of other flexible materials such as Santoprene made by Monsanto or a combination of polyvinyl chloride and neoprene. Similarly, the sheath 38 can be formed by other processes such as die cast molding or compression molding.

As shown in FIG. 2, the mounting member 30 and sheath 38 are preferably generally C-shaped in cross section for complementarily receiving the leading member 12 therein. However, it is understood by those skilled in the art that the sheath 38 and mounting member 30 could be constructed of other configurations to complement leading members of different shapes. For instance, as shown in the alternate embodiments of FIGS. 5 and 6, the leading member 12 is generally in the form of a parallelogram and the mounting member 30 and sheath 38 are generally U-shaped in cross-section to complementarily receive the leading member 12 therein.

Referring now to FIG. 2, although the mounting member 30 is configured to receive the leading member 12 with a snap-fit, it may be preferable to include fastening elements to further secure the sensing edge 14 to the leading member 12. In the present embodiment, self-tapping screws 46 are provided for securing the lateral edges 32a, 32b of the mounting member 30 to the brackets 18 and/or leading member 12, as is understood by those skilled in the art. It is also understood by those skilled in the art that other fastening elements could be used to further secure the mounting member 30 to the leading member 12, such as rivets or an adhesive (not shown), without departing from the spirit and scope of the invention.

The utilization of a snap fit in combination with the standard fastening elements provides a sensing edge 14 which is firmly secured to the leading member 12. That is, in the event that one or more fastening elements fail, the snap fit retains the sensing edge 14 on the leading member 12 until the system is inspected and the fastening elements are repaired.

As shown in FIGS. 2 and 3, the first and second lateral edges 40a, 40b of the sheath 38 are releasably secured to the mounting member 30 to provide access to the second area 44, thus facilitating repair and manufacture of the sensing edge 14. In the present embodiment, it is preferred that the first and second lateral edges 40a, 40b of the sheath 38 be releasably secured to the mounting member 30 by a snap-fit arrangement. That is, the outer surface 34b of the mounting member 30 includes a pair of longitudinally extending channels 48 proximate the first and second lateral edges 40a, 40b extending outwardly from the mounting member 30. The channels 48 are generally rectangularly shaped in cross section and extend the entire length of the mounting member 30. The channels each include a slot 50 also extending the entire length thereof. A finger 52 extends from the lateral edges 40a, 40b of the sheath inwardly from the interior surface 42a of the sheath 38. The finger 52 has a first portion which is shaped to complement the slot 50 and a second portion which is generally triangularly shaped in cross section and is sized to snap into the hollow portion of the channels 48. The finger 52 preferably extends the entire length of the sheath 38 to insure that the first and second lateral edges 40a, 40b of the sheath 38 are securely attached to the mounting member 30.

It is understood by those skilled in the art that other means could be used to releasably secure the first and second lateral edges 40a, 40b of the sheath 38 to the mounting member 30. For instance, the fingers 52 could be friction fit within the slots 50 or the channels 48 could be solid for receiving standard fasteners. If desired, one or both of the first and second lateral edges 40a, 40b could be permanently secured to the channels 48 by depositing an adhesive (not shown) within the hollow portion of the channels 48 along with the finger 52.

The sensing edge 14 is preferably used for detecting objects in proximity to the leading member 12 of the gate 10 and includes a switch means positioned within the second area 44 for actuation of the device or drive mechanism (discussed above) upon application of pressure to the exterior surface of the sheath 38. The switch means preferably comprises a force sensing switch positioned within the sheath 38 to sense objects in proximity to the leading member 12 of the gate 10. The switch comprises a first sheet of resiliently compressible material 58 which is positioned within the second area 44 and includes a first face and a second face. The first face of the first sheet of resiliently compressible material 58 is in engagement with the outer surface 34a of the mounting member 30.

In the present embodiment, it is preferred that the first sheet of resiliently compressible material 58 and succeeding layers and sheets described hereinafter, be generally sized to complement the internal configuration of the second area 44. However, it is understood by those skilled in the art that the first sheet of resiliently compressible material 58 and succeeding layers and sheets can be sized as wide or narrow as desired and may be of any desired length for accommodating different structures and uses.

In the present embodiment, it is preferred that the first sheet of resiliently compressible material 58 be constructed of generally soft foam rubber. It is understood by those skilled in the art that the first sheet of resiliently compressible material 58 can be constructed of either closed- or open-cell foam rubber or other material having similar properties.

Proximate the first sheet of resiliently compressible material 58 is a first sheet of flexible, electrically conductive material 60, engaged therewith, and having a first face and a second face. The first face of the first sheet of flexible, electrically conductive material 60 is in engagement with the second face of the first sheet of resiliently compressible material 58. In the present embodiment, it is preferred that the first sheet of flexible, electrically conductive material 60 be generally thin and preferably be constructed of aluminum or aluminum foil. However, it is within the spirit and scope of the invention to construct the first sheet of flexible, electrically conductive material 60 of other conductive materials, such as copper, brass or an alloy thereof.

An electrical conductor or wire (not shown) is electrically connected to the first sheet of flexible, electrically conductive material 60 preferably by soldering at one end thereof. The electrical conductor is used in connection with a circuit (not shown) for controlling the actuation of the device, as is understood by those skilled in the art, in response to the application of force to the sheath 38, as described hereinafter. It is also understood by those skilled in the art that a plurality of conductors or wires could be electrically connected to the first sheet of flexible, electrically conductive material 60 to provide a redundancy feature.

The first sheet of flexible, electrically conductive material 60 is in engagement with a layer of non-conductive material 62 having a first face and a second face for spacing apart the first sheet of flexible, electrically conductive material 60 and a second sheet of flexible, electrically conductive material 64. The layer of non-conductive material 62 has at least one opening 66 extending therethrough between the first and second faces thereof. As shown in FIG. 4, the layer of non-conductive material 62, preferably includes a plurality of openings 66 interspersed therealong for allowing the actuation of the switch (not shown) by applying pressure thereto, as described hereinafter. In the present embodiment, it is preferred that the opening 66 be generally oval-shaped in cross section. However, it is within the spirit and scope of the invention to configure the openings 66 in any geometric configuration, such as square or circular.

The layer of non-conductive material 62 is preferably constructed of generally soft foam rubber. It is understood by those skilled in the art that the layer of non-conductive material 62 can be constructed of either closed- or open-cell foam rubber or other materials having similar properties, so long as the function of the switch is achieved, as described hereinafter.

The layer of non-conductive material 62 is in engagement with the second sheet of flexible, electrical conductive material 64 having a first face and a second face. The first face of the second sheet of flexible, electrically conductive material 64 is in engagement or corresponding facing relationship with the second face of the layer of non-conductive material 62.

In the present embodiment, it is preferred that the second sheet of flexible, electrically conductive material 64 be constructed of the same material and configuration as the first sheet of flexible, electrically conductive material 60. Similarly, the second sheet of flexible, electrically conductive material 64 is connected to an electrical conductor or wire (not shown) or a plurality thereof for connection with the circuit for controlling the actuation of the device in response to the application of force to the sheath 38.

In engagement with the second sheet of flexible, electrically conductive material 64 is a second sheet of resiliently compressible material 68 having a first face and a second face. The first face of the second sheet of resiliently compressible material 68 is in engagement or corresponding facing relationship with the second face of the second sheet of flexible, electrically conductive material 64. The second face of the second sheet of resiliently compressible material 68 is in engagement with the interior surface 42a of the sheath 38.

The second sheet of resiliently compressible material 68 is preferably constructed of the same material and configured generally identically to the first sheet of resiliently compressible material 58. However, it is apparent to those skilled in the art that the first and second sheets of resiliently compressible material 58, 68 can differ in configuration, size and/or material.

As shown in FIG. 2, the first and second sheets of flexible, electrically conductive material 60, 64 are spaced apart by the layer of non-conductive material 62 and present equal portions to each other through the openings 66. Upon the application of force to the sheath 38, a portion of at least one of the first and second sheets of flexible, electrically conductive material 60, 64 deflects into at least one of the openings 66 in the layer of non-conductive material, and makes electrical contact between the first and second sheets of flexible, electrically conductive material 60, 64 to thereby close or open an electrical circuit to actuate the device to effect a desired result, such as causing the closing gate 10 to stop moving. Alternatively, the device could cause the closing gate to open or could cause the closing gate to stop and then move one foot in the open direction.

While it is preferred that the sensing edge 14 include a force sensing switch as described above, it is understood by those skilled in the art that the present invention is not limited to any particular switch means. For instance, the switch means could be of the type disclosed in U.S. Pat. Nos. 3,462,885; 4,785,143; 4,908,483 and 4,920,241 all of which are hereby incorporated by reference.

Referring now to FIG. 5, there is shown a sensing edge 14 in accordance with a first alternate embodiment of the invention. The first alternate embodiment is directed to a gate having a leading member 12 which is generally in the form of a parallelogram in cross section. The sensing edge 14 in accordance with the first alternate embodiment is generally identical to the sensing edge 14 described above in connection with the preferred embodiment, except that the mounting member 30 is configured to complement the different shape leading member 12. That is, the mounting member 30 includes a mounting plate 70 having a first end 70a, a second end 70b, an inner surface 70c and an outer surface 70d. A first elongated clamping member 72 extends from the first end 70a of the mounting plate 70 to thereby form an angle therebetween. A second elongated clamping member 74 extends from the second end 70b of the mounting plate 70 to thereby form an angle therebetween. The first and second clamping members 72, 74 each include an inner surface 72a, 74a and an outer surface 72b, 74b. The mounting plate 70, first clamping member 72 and second clamping member 74 are generally trihedially-shaped in cross section such that the inner surfaces 70c, 72a, 74a thereof define a first area 76 for receiving in facing engagement a portion of the leading member 12.

The first clamping member 72 is spaced from the second clamping member 74 a distance which is less than the predetermined width of the leading member 12. The mounting member 30 is constructed of a material having a sufficient degree of flexibility to allow the clamping members 72, 74 of the mounting member 30 to move toward and away from each other such that the leading member 12 can be snap-fit within the first area 76 to thereby secure the sensing edge 14 to the leading member 12. As in the preferred embodiment, the first alternate embodiment also includes screws 46 for further securing the sensing edge 14 to the leading member 12.

Referring now to FIG. 6, there is shown a sensing edge 14 in accordance with a second alternate embodiment of the present invention. The sensing edge 14 of the second alternate embodiment is generally identical to the sensing edge 14 described above in connection with the second alternate embodiment shown in FIG. 5 except that the first and second clamping members 72, 74 and associated elements of the switch extend a greater distance around the leading member 12 to provide a greater sensing area. Accordingly, further description of the second alternate embodiment is omitted for purposes of convenience only and is not limiting.

In use, an appropriately shaped sensing edge 14 is selected for use with a particularly shaped leading member 12 of a gate 10. The sensing edge 14 is then snap-fit to the leading member 12 of the gate 10 and further fastening elements, such as screws 46, are used, if desired. The sensing edge 14 is then connected to suitable control circuitry. Since the sensing edge 14 extends around a significant portion of the leading member 12, the sensing edge 14 senses objects which approach the leading member 12 at a wide angle, such as 180°, regardless of whether the gate 10 is vertically, horizontally or pivotally mounted for movement. Upon the application of force to the sheath 38, a portion of at least one of the first and second sheets of flexible, electrically conductive material 60, 64 deflects into at least one of the openings 66 in the layer of non-conductive material 62 and makes electrical contact between the first and second sheets of electrically conductive material 60, 64 to thereby close or open an electrical circuit to actuate the device, as discussed above.

From the foregoing description, it can be seen that the present invention comprises a sensing edge 14 for causing a closing gate 10 to open by actuation of a device upon force being applied to the sensing edge 14. It will be appreciated by those skilled in the art that changes could be made to the embodiments described above without departing from the broad inventive concepts thereof. It is understood, therefore, that this invention is not limited to the particular embodiments disclosed, but is intended to cover all modifications which are within the spirit and scope of the invention as defined by the appended claims.

We claim:

1. A sensing edge for a gate to protect persons, equipment and the gate from impact damage, the gate including a leading member having an external surface and a maximum lateral width, said sensing edge comprising:

a mounting member for securing the sensing edge to the leading member of the gate, said mounting member including first and second lateral edge spaced apart a distance less than the maximum lateral width of the leading member, said mounting member further including an outer surface and an inner surface defining a first area for receiving in facing engagement a portion of the leading member, said inner surface being sized and shaped to extend around a portion of the external surface of the leading member having the maximum lateral width, said mounting member being constructed of a material having a sufficient degree of flexibility to allow said first and second lateral edges of said mounting member to move toward and away from each other such that the maximum lateral width portion of the leading member can be snap fit within the first area to thereby secure the sensing edge to the leading member;

an elongated outer sheath having a first lateral edge, a second lateral edge, an interior edge and an exterior surface, said first and second lateral edges of said sheath being spaced apart and secured to said mounting member proximate said first and second lateral edges of said mounting member, said interior surface of said sheath being spaced from said outer surface of said mounting member to thereby define a second area for receiving a switch means; and a switch means complementarily positioned within the second area for actuation of the device upon application of pressure substantially anywhere along the exterior surface of the sheath.

2. A sensing edge according to claim 1 wherein said switch means further comprises:

a first sheet of resiliently compressible material having a first face and a second face, the first face of the first sheet of resiliently compressible material being in corresponding facing engagement with a portion of the outer surface of said mounting member;

a first sheet of flexible, electrically conductive material having a first face and a second face, the first face of the first sheet of flexible, electrically conductive material being in corresponding facing engagement with the second face of the first sheet of resiliently compressible material;

a layer of non-conductive material having a first face and a second face, the first face of the layer of non-conductive material being in corresponding facing engagement with the second face of the first sheet of flexible, electrically conductive material, the layer of non-conductive material including at least one opening extending therethrough between the first and second faces thereof;

a second sheet of flexible, electrically conductive material having a first face and a second face, the first face of the second sheet of flexible, electrically conductive material being in corresponding facing engagement with the second face of the layer of non-conductive material; and a second sheet of resiliently compressible material having a first face and a second face, the first face of the second sheet of resiliently compressible material being in corresponding facing engagement with the second face of the second sheet of flexible, electrically conductive material, the second face of the second sheet of resiliently compressible material being in corresponding facing engagement with said interior surface of said sheath, the first and second sheets of flexible, electrically conductive material being spaced apart by the layer of non-conductive material and presenting opposed portions to each other through the opening whereby upon the application of force substantially anywhere along the exterior surface of the sheath, a portion of at least one of the first and second sheets of flexible, electrically conductive material deflects into the opening in the layer of non-conductive material and makes electrical contact between the first and second sheets of flexible, electrically conductive material to thereby actuate a device to effect a desired result.

3. A sensing edge according to claim 1 wherein the first and second lateral edges of the said sheath are releasably secured to said mounting member.

4. A sensing edge according to claim 1 wherein said material is polyvinyl chloride.

5. A sensing edge for a gate to protect persons, equipment and the gate from impact damage, the gate including a generally cylindrically shaped leading member having a predetermined diameter and a maximum lateral width, said sensing edge comprising:

a mounting member for securing the sensing edge to the leading member of the gate, said mounting member being generally c-shaped in cross section, having first and second lateral edges spaced apart a distance less than the maximum lateral width of the leading member, and including an outer surface and a generally curved radial inner surface defining a first area for receiving in facing engagement a portion of the leading member having the maximum lateral width, said mounting member being constructed of a material having a sufficient degree of flexibility to allow said first and second lateral edges of said mounting member to move toward and away from each other such that the maximum lateral width portion of the leading member can be snap fit within the first area to thereby secure the sensing edge to the leading member;

an elongated outer sheath having a first lateral edge, a second lateral edge, an interior surface and an exterior surface, said first and second lateral edges being spaced apart and secured to said mounting member, said interior surface of said sheath being spaced from said outer surface of said mounting member to thereby define a second area for receiving a switch means; and a switch means positioned within the second area for actuation of the device upon application of pressure to the exterior surface of the sheath.

6. A sensing edge according to claim 5 wherein said material is polyvinyl chloride.

7. A sensing edge according to claim 5 wherein said switch means further comprises:

a first sheet of resiliently compressible material having a first face and a second face, the first face of the first sheet of resiliently compressible material being in corresponding facing engagement with a portion of the outer surface of said mounting member;

a first sheet of flexible, electrically conductive material having a first face and a second face, the first face of the first sheet of flexible, electrically conductive material being in corresponding facing engagement with the second face of the first sheet of resiliently compressible material;

a layer of non-conductive material having a first face and a second face, the first face of the layer of non-conductive material being in corresponding facing engagement with the second face of the first sheet of flexible, electrically conductive material, the layer of non-conductive material including at least one opening extending therethrough between the first and second faces thereof;

a second sheet of flexible, electrically conductive material having a first face and a second face, the first face of the second sheet of flexible, electrically conductive material being in corresponding facing engagement with the second face of the layer of non-conductive material; and a second sheet of resiliently compressible material having a first face and a second face, the first face of the second sheet of resiliently compressible material being in corresponding facing engagement with the second face of the second sheet of flexible, electrically conductive material, the second face of the second sheet of resiliently compressible material being in corresponding facing engagement with said interior surface of said sheath, the first and second sheets of flexible, electrically conductive material being spaced apart by the layer of non-conductive material and presenting opposed portions to each other through the opening whereby upon the application of force substantially anywhere along the exterior surface of the sheath, a portion of at least one of the first and second sheets of flexible, electrically conductive material deflects into the opening in the layer of non-conductive material and makes electrical contact between the first and second sheets of flexible, electrically conductive material to thereby actuate a device to effect a desired result.

8. A sensing edge according to claim 5 wherein the first and second lateral edges of said sheath are releasably secured to said mounting member.

9. A sensing edge for a gate to protect persons, equipment and the gate from impact damage, the gate including a leading member which is generally in the form of a parallelogram in cross section, the parallelogram having a predetermined width, said sensing edge comprising:

a mounting member for securing the sensing edge to the leading member of the gate, said mounting member including a mounting plate having a first end, a second end, an inner surface and an outer surface, a first elongated clamping member extending from said first end of said mounting plate to a first tip to thereby form an angle with respect to the mounting member, a second elongated clamping member extending from said second end of said mounting plate to a second tip to thereby form an angle with respect to the mounting member, said first and second clamping members each including an inner surface and an outer surface, said mounting plate, first clamping member and second clamping member being generally trihedrally shaped in cross section such that the first and second tips of the first and second elongated clamping members are spaced a distance less than the predetermined width of the leading member and such that the inner surfaces thereof define a first area for receiving in facing engagement a portion of the leading member, said mounting member being constructed of a material having a sufficient degree of flexibility to allow said first and second tips of said first and second clamping members to move toward and away from each other such that the predetermined width of the leading member can be snap fit within the first area to thereby secure the sensing edge to the leading member;

an elongated outer sheath having a first lateral edge, a second lateral edge, an interior surface and an exterior surface, said first and second lateral edges being spaced part and secured to said first and second clamping members of said mounting member, respectively, said interior surface of said sheath being spaced from said outer surface of said mounting plate, first clamping member and second clamping member to thereby define a second area for receiving a switch means; and a switch means complementarily positioned within the second area for actuation of the device upon application of pressure substantially anywhere along the exterior surface of the sheath.

10. A sensing edge according to claim 9 wherein said material is polyvinyl chloride.

11. A sensing edge according to claim 9 wherein said switch means further comprises:

a first sheet of resiliently compressible material having a first face and a second face, the first face of the first sheet of resiliently compressible material being in corresponding facing engagement with a portion of the outer surface of said mounting member;

a first sheet of flexible, electrically conductive material having a first face and a second face, the first face of the first sheet of flexible, electrically conductive material being in corresponding facing engagement with the second face of the first sheet of resiliently compressible material;

a layer of non-conductive material having a first face and a second face, the first face of the layer of non-conductive material being in corresponding facing engagement with the second face of the first sheet of flexible, electrically conductive material, the layer of non-conductive material including at least one opening extending therethrough between the first and second faces thereof;

a second sheet of flexible, electrically conductive material having a first face and a second face, the first face of the second sheet of flexible, electrically conductive material being in corresponding facing engagement with the second face of the layer of non-conductive material; and a second sheet of resiliently compressible material having a first face and a second face, the first face of the second sheet of resiliently compressible material being in corresponding facing engagement with the second face of the second sheet of flexible, electrically conductive material, the second face of the second sheet of resiliently compressible material being in corresponding facing engagement with said interior surface of said sheath, first clamping member and said second clamping member, the first and second sheets of flexible, electrically conductive material being spaced apart by the layer of non-conductive material and presenting opposed portions to each other through the opening whereby upon the application of force substantially anywhere along the exterior surface of the sheath, a portion of at least one of the first and second sheets of flexible, electrically conductive material deflects into the opening in the layer of non-conductive material and makes electrical contact between the first and second sheets of flexible, electrically conductive material to thereby actuate a device to effect a desired result.

12. A sensing edge according to claim 9 wherein the first and second lateral edges of the said sheath are releasably secured to said first and second clamping members, respectively.

* * * * *